US010530100B1

(12) United States Patent
Henry et al.

(10) Patent No.: US 10,530,100 B1
(45) Date of Patent: Jan. 7, 2020

(54) COMMUNICATION CONNECTOR FOR A COMMUNICATION SYSTEM

(71) Applicant: TE CONNECTIVITY CORPORATION, Berwyn, PA (US)

(72) Inventors: Randall Robert Henry, Lebanon, PA (US); Michael John Phillips, Camp Hill, PA (US); Bruce Allen Champion, Camp Hill, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/176,177

(22) Filed: Oct. 31, 2018

(51) Int. Cl.
*H01R 13/658* (2011.01)
*H01R 13/6587* (2011.01)
*H01R 13/6597* (2011.01)
*H01R 12/73* (2011.01)

(52) U.S. Cl.
CPC ..... *H01R 13/6587* (2013.01); *H01R 13/6597* (2013.01); *H01R 12/73* (2013.01)

(58) Field of Classification Search
CPC . H01R 13/6587; H01R 13/6597; H01R 12/73
USPC ..... 439/62
See application file for complete search history.

(56) References Cited

U.S. PATENT DOCUMENTS 7,731,197 B2 * 6/2010 Stutz ..... F41J 7/04 273/392
7,837,475 B2 * 11/2010 Mizukami ..... H01R 12/57 439/607.05
8,398,433 B1 * 3/2013 Yang ..... H01R 31/08 439/108
8,523,625 B2 * 9/2013 Kanemaru ..... H01T 21/02 445/7
9,312,618 B2 * 4/2016 Regnier ..... H01R 9/2408
9,413,112 B2 * 8/2016 Helster ..... H01R 13/6467
9,553,381 B2 * 1/2017 Regnier ..... H01R 13/6473
2005/0142944 A1 * 6/2005 Ling ..... H01R 13/658 439/607.05
2012/0003848 A1 * 1/2012 Casher ..... H05K 1/0222 439/65
2014/0073174 A1 * 3/2014 Yang ..... H01R 13/6461 439/485

FOREIGN PATENT DOCUMENTS

WO 2015035052 A1 3/2015

* cited by examiner

*Primary Examiner* — Alexander Gilman

(57) ABSTRACT

A communication connector includes a wafer stack including ground wafers and signal wafers arranged in a stacked configuration. Each signal wafer includes a dielectric frame holding a signal leadframe including a plurality of signal contacts. Each ground wafer includes a dielectric frame holding a ground leadframe including ground plates connected by tie bars and rail slots therethrough. The communication connector includes ground rails separate from the ground wafers and being plugged into the wafer stack to electrically connect to corresponding ground wafers. The ground rails have rail tabs received in corresponding rail slots being coupled to ground plates of corresponding ground wafers. Each rail tab extends through at least one signal wafer to provide electrical shielding for signal contacts of the at least one signal wafer. Each rail tab is coupled to at least two different ground wafers to electrically connect the at least two different ground wafers.

20 Claims, 12 Drawing Sheets

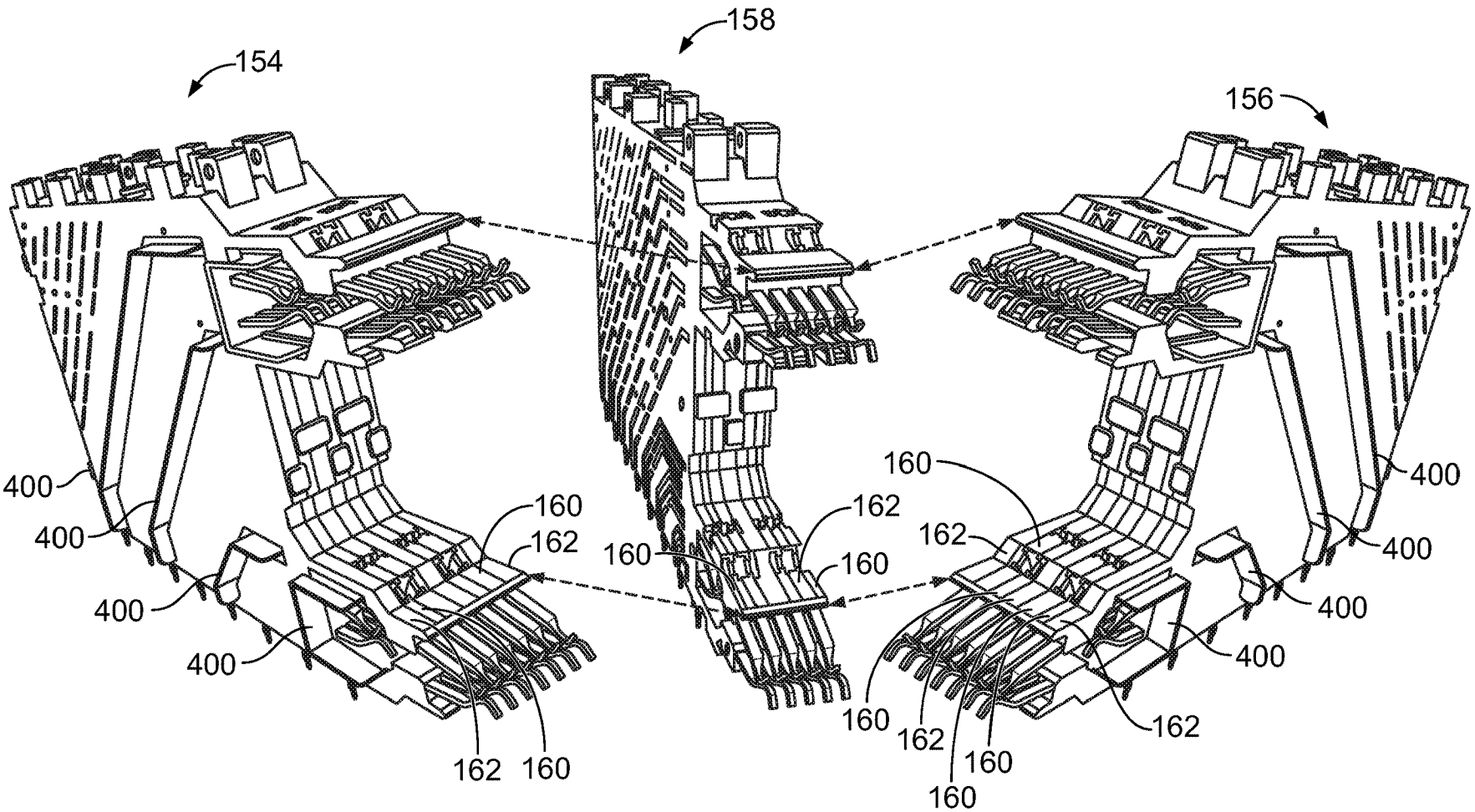
156
158
154
400
400
400

COMMUNICATION CONNECTOR FOR A COMMUNICATION SYSTEM

BACKGROUND OF THE INVENTION

The subject matter herein relates generally to communication systems.

Some communication systems utilize communication connectors to interconnect various components of the system for data communication. Some known communication systems use pluggable modules, such as I/O modules, that are electrically connected to the communication connector. Conventional communication systems have performance problems, particularly when transmitting at high data rates. Known communication systems provide electrical shielding in the communication connector. However, at high data rates, the electrical shielding in the communication connector is inadequate.

A need remains for a communication system having electrical shielding for high speed data signals.

BRIEF DESCRIPTION OF THE INVENTION

In one embodiment, a communication connector for a communication system is provided including a wafer stack including ground wafers and signal wafers arranged in a stacked configuration. Each signal wafer includes a dielectric frame holding a signal leadframe including a plurality of signal contacts. Each ground wafer includes a dielectric frame holding a ground leadframe including ground plates connected by tie bars and rail slots therethrough. The communication connector includes ground rails separate from the ground wafers and being plugged into the wafer stack to electrically connect to corresponding ground wafers. The ground rails have rail tabs received in corresponding rail slots being coupled to ground plates of corresponding ground wafers. Each rail tab extends through at least one signal wafer to provide electrical shielding for signal contacts of the at least one signal wafer. Each rail tab is coupled to at least two different ground wafers to electrically connect the at least two different ground wafers.

In another embodiment, a communication connector for a communication system is provided including a left grounded wafer stack, a right grounded wafer stack and a center wafer stack. The center wafer stack is located between the left and right grounded wafer stacks. The left grounded wafer stack includes ground wafers and signal wafers arranged in a stacked configuration. Each signal wafer of the left grounded wafer stack includes a dielectric frame holding a signal leadframe including a plurality of signal contacts. Each ground wafer of the left grounded wafer stack includes a dielectric frame holding a ground leadframe including ground plates connected by tie bars and having rail slots therethrough. The left grounded wafer stack includes ground rails separate from the ground wafers being plugged into the left grounded wafer stack to electrically connect to corresponding ground wafers. The ground rails have rail tabs received in corresponding rail slots being coupled to ground plates of corresponding ground wafers. Each rail tab extends through at least one signal wafer to provide electrical shielding for signal contacts of the at least one signal wafer. Each rail tab is coupled to at least two different ground wafers to electrically connect the at least two different ground wafers. The right grounded wafer stack has ground wafers and signal wafers arranged in a stacked configuration. Each signal wafer of the right grounded wafer stack includes a dielectric frame holding a signal leadframe including a plurality of signal contacts. Each ground wafer of the right grounded wafer stack includes a dielectric frame holding a ground leadframe including ground plates connected by tie bars and having rail slots therethrough. The right grounded wafer stack includes ground rails separate from the ground wafers being plugged into the right grounded wafer stack to electrically connect to corresponding ground wafers. The ground rails have rail tabs received in corresponding rail slots being coupled to ground plates of corresponding ground wafers. Each rail tab extends through at least one signal wafer to provide electrical shielding for signal contacts of the at least one signal wafer. Each rail tab is coupled to at least two different ground wafers to electrically connect the at least two different ground wafers. The center wafer stack has ground wafers and signal wafers arranged in a stacked configuration. Each signal wafer includes a dielectric frame holding a signal leadframe including a plurality of signal contacts. Each ground wafer includes a dielectric frame holding a ground leadframe including ground plates. The ground wafers of the center wafer stack are electrically isolated from each other.

In a further embodiment, a communication system is provided including a receptacle cage configured to be mounted to a circuit board having walls including a top wall, a front wall, a rear wall and sidewalls defining a cavity configured to receive a pluggable module. The communication system includes a communication connector received in the receptacle cage for mating with the pluggable module. The communication connector includes a wafer stack including ground wafers and signal wafers arranged in a stacked configuration. Each signal wafer includes a dielectric frame holding a signal leadframe including a plurality of signal contacts. Each ground wafer includes a dielectric frame holding a ground leadframe including ground plates connected by tie bars and rail slots therethrough. The communication connector includes ground rails separate from the ground wafers and being plugged into the wafer stack to electrically connect to corresponding ground wafers. The ground rails have rail tabs received in corresponding rail slots being coupled to ground plates of corresponding ground wafers. Each rail tab extends through at least one signal wafer to provide electrical shielding for signal contacts of the at least one signal wafer. Each rail tab is coupled to at least two different ground wafers to electrically connect the at least two different ground wafers.

BRIEF DESCRIPTION OF THE DRAWINGS

FIG. 5 is an exploded view of the wafer stack in accordance with an exemplary embodiment.

DETAILED DESCRIPTION OF THE INVENTION

Figure 1:
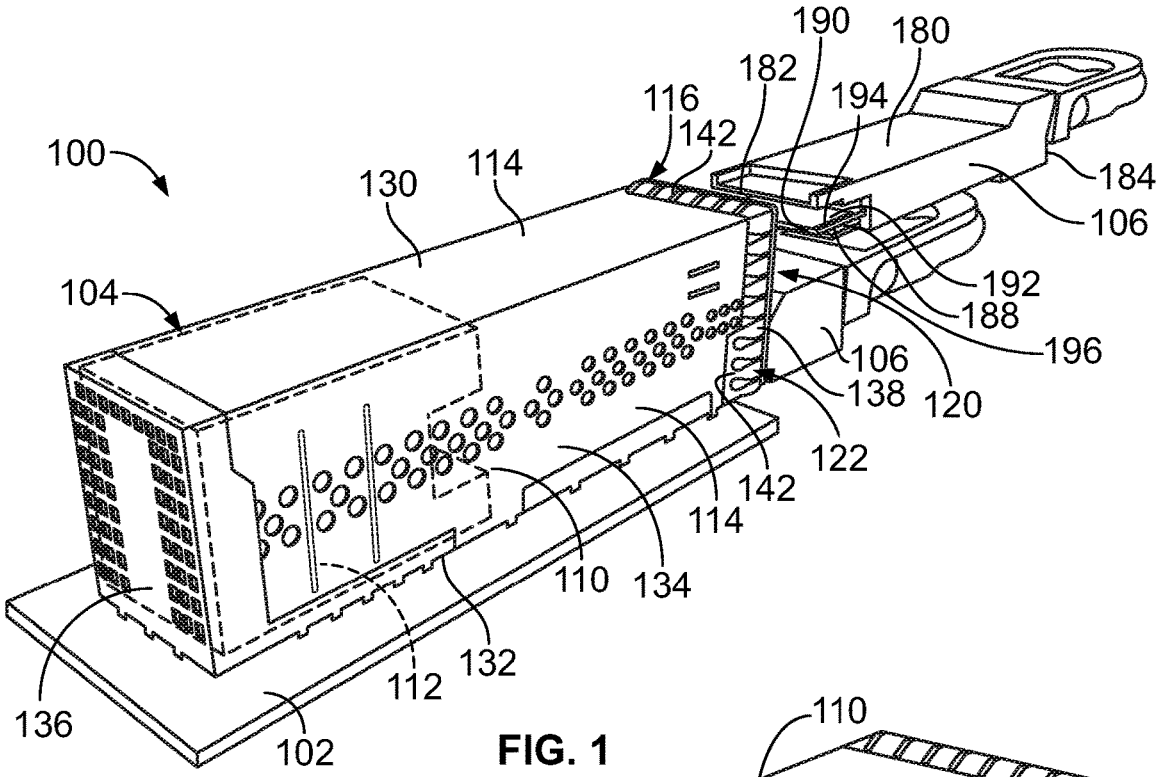
FIG. 1 is a rear perspective view of communication system formed in accordance with an exemplary embodiment.

FIG. 1 is a front perspective view of communication system 100 formed in accordance with an exemplary embodiment. The communication system includes a circuit board 102 and a receptacle connector assembly 104 mounted to the circuit board 102. Pluggable modules 106 are configured to be electrically connected to the receptacle connector assembly 104. The pluggable modules 106 are electrically connected to the circuit board 102 through the receptacle connector assembly 104.

In an exemplary embodiment, the receptacle connector assembly 104 includes a receptacle cage 110 and a communication connector 112 (shown in FIG. 2) adjacent the receptacle cage 110. For example, in the illustrated embodiment, the communication connector 112 is received in the receptacle cage 110. In other various embodiments, the communication connector 112 may be located rearward of the receptacle cage 110. In various embodiments, the receptacle cage 110 is enclosed and provides electrical shielding for the communication connector 112. The pluggable modules 106 are loaded into the receptacle cage 110 and are at least partially surrounded by the receptacle cage 110. The receptacle cage 110 includes a plurality of walls 114 defining a cavity 116. The cavity 116 may receive a portion of the communication connector 112. The cavity 116 may be divided into one or more module channels for receipt of corresponding pluggable modules 106. The walls 114 may be walls defined by solid sheets, perforated walls to allow airflow therethrough, walls with cutouts, such as for a heatsink or heat spreader to pass therethrough, or walls defined by rails or beams with relatively large openings, such as for airflow therethrough. In an exemplary embodiment, the receptacle cage 110 is a shielding, stamped and formed cage member with the walls 114 being shielding walls 114. In other embodiments, the receptacle cage 110 may be open between frame members, such as rails or beams, to provide cooling airflow for the pluggable modules 106 with the frame members of the receptacle cage 110 defining guide tracks for guiding loading of the pluggable modules 106 into the receptacle cage 110.

In the illustrated embodiment, the receptacle cage 110 constitutes a stacked cage member having an upper module channel 120 and a lower module channel 122. The receptacle cage 110 has upper and lower module ports (not shown) that open to the module channels 120, 122 that receive the pluggable modules 106. Any number of module channels may be provided in various embodiments. In the illustrated embodiment, the receptacle cage 110 includes the upper and lower module channels 120, 122 arranged in a single column, however, the receptacle cage 110 may include multiple columns of ganged module channels 120, 122 in alternative embodiments (for example, 2×2, 3×2, 4×2, 4×3, etc.). The receptacle connector assembly 104 is configured to mate with the pluggable modules 106 in both stacked module channels 120, 122. Optionally, multiple communication connectors 112 may be arranged within the receptacle cage 110, such as when multiple columns of module channels 120, 122 are provided.

In an exemplary embodiment, the walls 114 of the receptacle cage 110 include a top wall 130, a bottom wall 132, and sidewalls 134 extending between the top wall 130 and the bottom wall 132. The bottom wall 132 may rest on the circuit board 102. In other various embodiments, the receptacle cage 110 may be provided without the bottom wall 132. Optionally, the walls 114 of the receptacle cage 110 may include a rear wall 136 and a front wall 138 at the front of the receptacle cage 110. The module ports are provided in the front wall 138. The walls 114 define the cavity 116. For example, the cavity 116 may be defined by the top wall 130, the bottom wall 132, the sidewalls 134, the rear wall 136 and the front wall 138. Other walls 114 may separate or divide the cavity 116 into the various module channels 120, 122. For example, the walls 114 may include one or more divider walls between the upper and lower module channels 120, 122. In various embodiments, the walls 114 may include a separator panel between the upper and lower module channels 120, 122. The separator panel may form a space between the upper and lower module channels 120, 122, such as for airflow, for a heat sink, for routing light pipes, or for other purposes.

In an exemplary embodiment, the receptacle cage 110 may include one or more gaskets 142 at the front wall 138 for providing electrical shielding for the module channels 120, 122. For example, the gaskets 142 may be configured to electrically connect with the pluggable modules 106 received in the corresponding module channels 120, 122. The gaskets 142 may extend along an exterior of the receptacle cage 110 for interfacing with a panel (not shown), such as in a cutout of the panel.

In an exemplary embodiment, the receptacle connector assembly 104 may include one or more heat sinks (not shown) for dissipating heat from the pluggable modules 106. For example, the heat sink may be coupled to the top wall 130 for engaging the upper pluggable module 106 received in the upper module channel 120. The heat sink may extend through the top wall 130 to directly engage the pluggable module 106. Other types of heat sinks may be provided in alternative embodiments. Optionally, the receptacle connector assembly 104 may include one or more heat sinks for engaging the lower pluggable module 106 in the lower module channel 122. For example, the lower heat sink may be provided in the separator panel between the upper and lower module channels 120, 122.

In an exemplary embodiment, the pluggable modules 106 are loaded through the front wall 138 to mate with the communication connector 112. The shielding walls 114 of the receptacle cage 110 provide electrical shielding around the communication connector 112 and the pluggable modules 106, such as around the mating interfaces between the communication connector 112 and the pluggable modules 106.

The pluggable module 106 has a pluggable body 180, which may be defined by one or more shells. The pluggable body 180 may be thermally conductive and/or may be electrically conductive, such as to provide EMI shielding for the pluggable module 106. The pluggable body 180 includes a rear end 182 and an opposite front end 184. The rear end 182 (also referred to herein as mating end 182) is configured to be inserted into the corresponding module channel 120 or 122. The front end 184 may be a cable end 184 having a cable extending therefrom to another component within the system.

Figure 2:
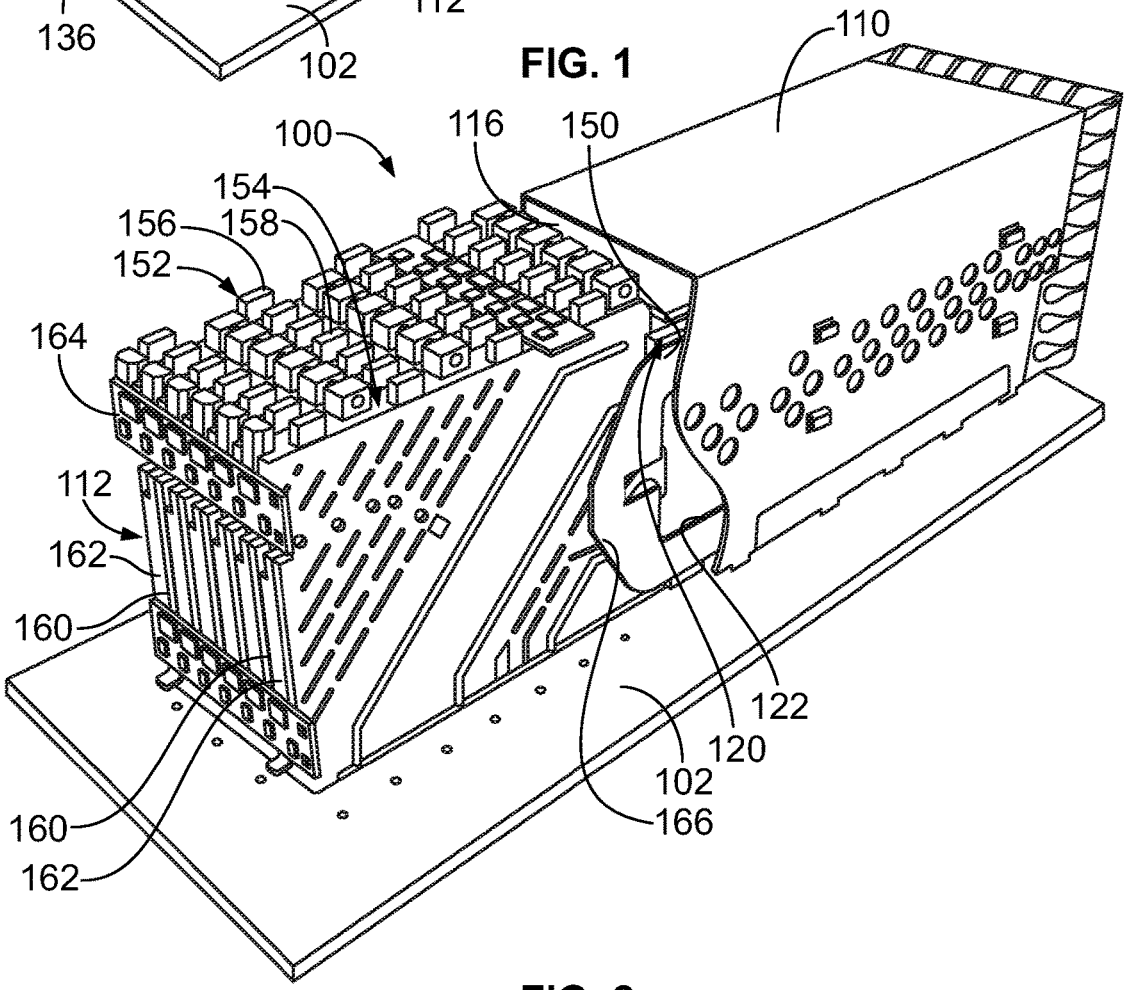
FIG. 2 is a rear perspective view of a portion of the communication system in accordance with an exemplary embodiment.

The pluggable module 106 includes a module circuit card 188 that is configured to be communicatively coupled to the communication connector 112 (shown in FIG. 2). The module circuit card 188 may be accessible at the mating end 182. For example, a card edge 190 of the module circuit card 188 is exposed at the mating end 182. The module circuit card 188 may include components, circuits and the like used for operating and or using the pluggable module 106. For example, the module circuit card 188 may have conductors, traces, pads, electronics, sensors, controllers, switches, inputs, outputs, and the like associated with the module circuit card 188, which may be mounted to the module circuit card 188, to form various circuits. For example, the module circuit card 188 includes contact pads 192 at the card edge 190 for mating with the communication connector 112. In an exemplary embodiment, the contact pads 192 are provided at an upper surface 194 and a lower surface 196 of the circuit card 188.

FIG. 2 is a rear perspective view of a portion of the communication system. A portion of the receptacle cage 110 is removed to illustrate the communication connector 112 in the cavity 116 of the receptacle cage 110. In an exemplary embodiment, the communication connector 112 is received in the cavity 116, such as proximate to the rear wall 136. However, in alternative embodiments, the communication connector 112 may be located behind the rear wall 136 exterior of the receptacle cage 110 and extend into the cavity 116 to interface with the pluggable module(s) 106. In an exemplary embodiment, a single communication connector 112 is used to electrically connect with the pair of stacked pluggable modules 106 in the upper and lower module channels 120, 122. In alternative embodiments, the communication system 100 may include discrete, stacked communication connectors 112 (for example, an upper communication connector and a lower communication connector) for mating with the corresponding pluggable modules 106.

The communication connector 112 includes a housing 150 at a front of the communication connector 112 and a wafer stack 152 at a rear of the communication connector 112. The wafer stack 152 is a stack of individual wafers each having a plurality of contacts configured to be mounted to the circuit board 102.

In an exemplary embodiment, the wafer stack 152 includes a left grounded wafer stack 154, a right grounded wafer stack 156 and a center wafer stack 158. The center wafer stack 158 is located between the left and right grounded wafer stacks 154, 156. The wafer stack 152 includes signal wafers 160 and ground wafers 162. The ground wafers 162 provide electrical shielding for the signal wafers 160. In various embodiments, one or more signal wafers 160 are arranged between corresponding ground wafers 162. In an exemplary embodiment, the signal wafers 160 are arranged in pairs and flanked by corresponding ground wafers 162, such as in a ground-signal-signal-ground arrangement. Other arrangements are possible in alternative embodiments.

In an exemplary embodiment, the signal wafers 160 of the left grounded wafer stack 154 and the right grounded wafer stack 156 convey high speed data signals and the signal wafers 160 of the center wafer stack 158 convey low speed data signals. The ground wafers 162 of the left grounded wafer stack 154 and the right grounded wafer stack 156 are electrically grounded and commoned with each other to provide electrical shielding for the signal wafers 160 of the left grounded wafer stack 154 and the right grounded wafer stack 156. In various embodiments, the ground wafers 162 of the center wafer stack 158 are not grounded or commoned to each other because the signal wafers of the center wafer stack 158 convey low speed signals. However, in other various embodiments, the ground wafers 162 of the center wafer stack 158 are grounded or commoned to each other and/or to the ground wafers 162 of the left and right wafer stacks 154, 156.

In an exemplary embodiment, the signal and ground wafers 160, 162 are connected by organizer plates 164. For example, the organizer plates 164 may be heat staked to the signal and ground wafers 160, 162. In an exemplary embodiment, the wafer stack 152 includes side plates 166 to connect the wafer stack 152 to the housing 150. The side plates 166 may be electrically connected to corresponding ground wafers 162.

Figure 4:
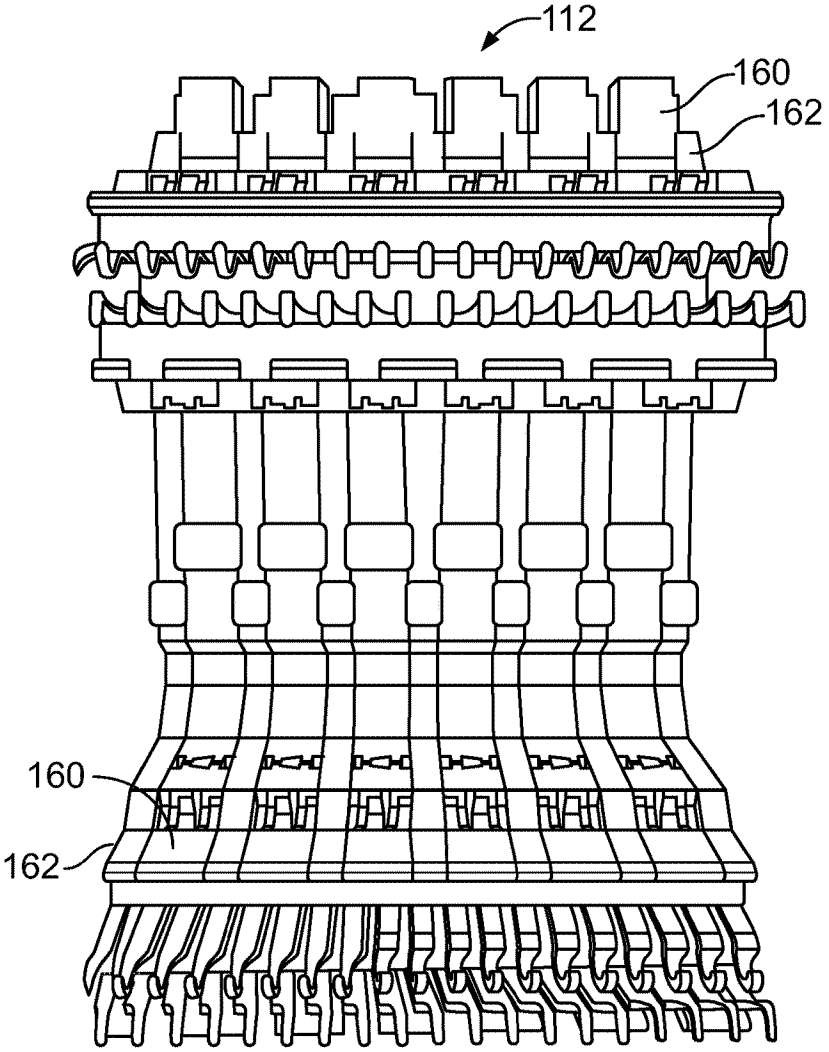
FIG. 4 is a front perspective view of a portion of the communication connector showing a wafer stack in accordance with an exemplary embodiment.
Figure 3:
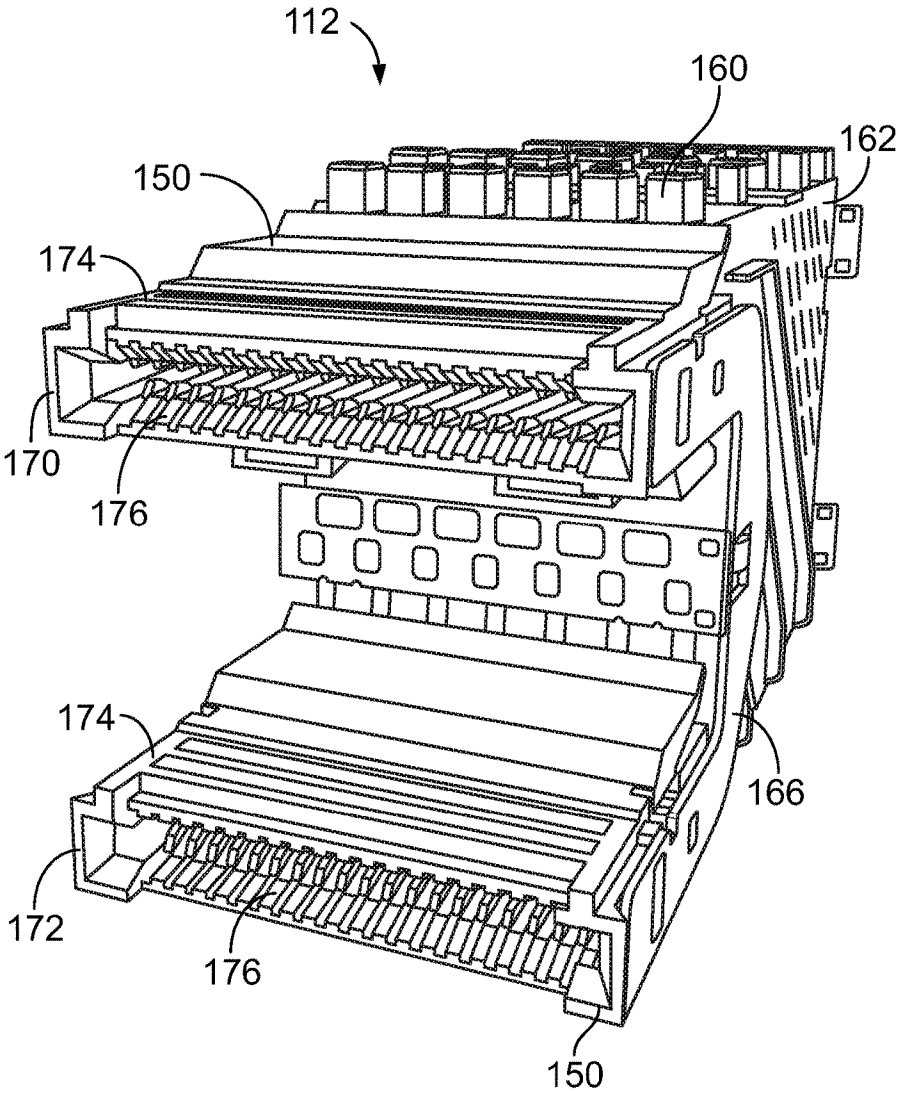
FIG. 3 is a front perspective view of a communication connector of the communication system in accordance with an exemplary embodiment.

FIG. 3 is a front perspective view of the communication connector 112 in accordance with an exemplary embodiment. FIG. 4 is a front perspective view of a portion of the communication connector 112 showing the wafer stack 152. The signal and ground wafers 160, 162 are arranged side-by-side in the wafer stack 152. The housing 150 is coupled to the front of the wafer stack 152.

In an exemplary embodiment, the housing 150 is a multipiece housing having an upper housing portion 170 and a lower housing portion 172. The upper housing portion 170 may be separate from the lower housing portion 172. Alternatively, the upper housing portion 170 may be coupled to the lower housing portion 172. In other various embodiments, the housing 150 may be a single, unitary housing having the upper and lower housing portions 170, 172 integrated as part of a unitary, monolithic structure. The upper and lower housing portions 170, 172 each include an extension 174 having a card slot 176. The card slot 176 is configured to receive the card edge 190 of the module circuit card 188 (shown in FIG. 1). Optionally, the upper and lower housing portions 170, 172 are connected by the side plates 166.

The wafer stack 152 is connected to the housing 150. For example, mating ends of the wafers 160, 162 may be loaded into the housing portions 170, 172. Contacts of the wafers 160, 162 are arranged in the card slot 176 for mating with the circuit card 188.

FIG. 5 is an exploded view of the wafer stack 152 showing the left wafer stack 154, the right wafer stack 156, and the center wafer stack 158. The left wafer stack 154, the right wafer stack 156, and the center wafer stack 158 each include ground wafers 162 and signal wafers 160 arranged in a stacked configuration. In an exemplary embodiment, the ground wafers 162 are similar or the same in each of the wafer stacks 154, 156, 158. In an exemplary embodiment, the signal wafers 160 are similar or the same in each of the wafer stacks 154, 156, 158.

In an exemplary embodiment, various ground wafers 162 are electrically connected by ground rails 400 separate from the ground wafers 162 and plugged into the wafer stack 152 electrically connect to corresponding ground wafers 162. In an exemplary embodiment, the left and right wafer stacks 154, 156 include ground rails 400 while the center wafer stack 158 does not include any ground rails 400. However, in alternative embodiments, the center wafer stack 158 may additionally include corresponding ground rails 400.

Figure 6:
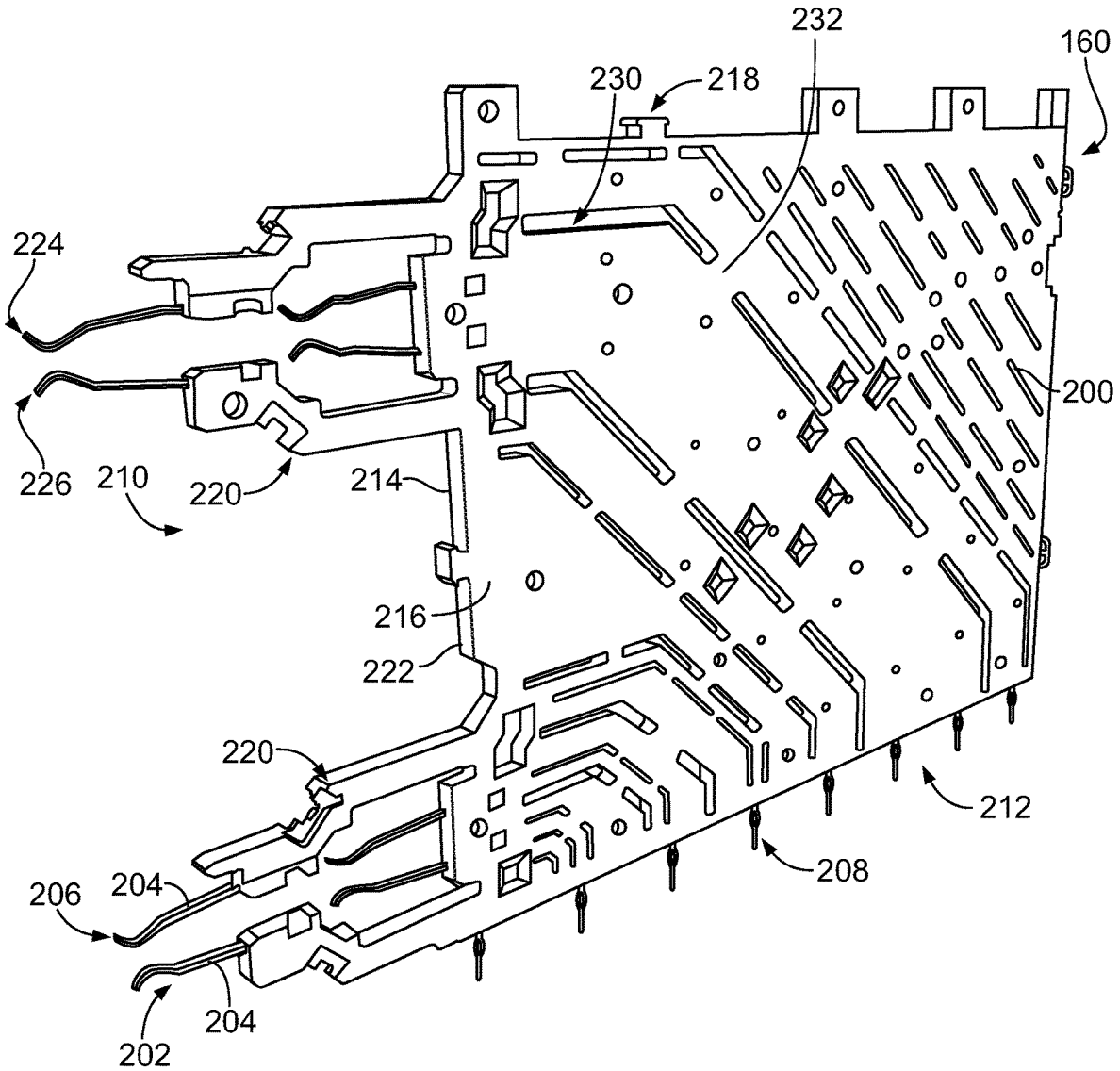
FIG. 6 is a perspective view of a signal wafer of the wafer stack in accordance with an exemplary embodiment.

With additional reference to FIG. 6, which is a perspective view of one of the signal wafers 160, each signal wafer 160 includes a dielectric frame 200 holding a signal leadframe 202 including a plurality of signal contacts 204. In various embodiments, the dielectric frame 200 is formed around the signal leadframe 202. For example, the dielectric frame 200 may be over molded on the signal leadframe 202. The signal contacts 204 are embedded in the dielectric frame 200. In an exemplary embodiment, each signal contact 204 extends between a mating end 206 and a terminating end 208. The mating end 206 is configured to be mated with the module circuit card 188 (shown in FIG. 1). For example, the mating end 206 may include a deflectable spring beam configured to be mated with a corresponding contact pad 192 on the circuit card 188 by a compression connection. The terminating end 208 is configured to be terminated to the circuit board 102 (shown in FIG. 1). For example, the terminating end 208 may include a compliant pin configured be press-fit into a plated via of the circuit board 102. In the illustrated embodiment, the mating end 206 is provided at a front 210 of the signal wafer 160 and the terminating end 208 is provided at a bottom 212 of the signal wafer 160 defining a right-angle wafer. The signal contacts 204 transition between the front 210 and the bottom 212, such as through one or more bends. Other orientations are possible in alternative embodiments.

In an exemplary embodiment, the dielectric frame 200 includes a first side 214 and a second side 216. Optionally, in various embodiments, the signal wafers 160 may be arranged in pairs having the first side 214 of one dielectric frame 200 facing the second side 216 of another dielectric frame 200. Ground wafers 162 may be provided on the other sides of the dielectric frames 200 in the wafer stack 154, 156, 158. The sides 214, 216 may be planar. The dielectric frame 200 may include securing features, such as posts and/or holes, to secure the dielectric frame 202 the adjacent signal wafer 160 or the ground wafer 162. In an exemplary embodiment, the signal wafers 160 include attachment features 218 configured to be attached to the organizer plate 164 (shown in FIG. 2).

In an exemplary embodiment, the signal wafer 160 includes mating protrusions 220 extending forward from a front wall 222 of the dielectric frame 200. In the illustrated embodiment, the signal wafer 160 includes mating protrusions 220, such as upper and lower mating protrusions 220. The upper and lower mating protrusions 220 are configured be received in the upper and lower housing portions 170, 172 (shown in FIG. 3). The mating ends 206 of the signal contacts 204 extend forward from the mating protrusions 220. In an exemplary embodiment, the mating ends 206 are arranged in an upper row 224 and a lower row 226 within each mating protrusion 220. The mating ends 206 in the upper row 224 are configured to engage the upper surface 194 of the circuit card 188 while the mating ends 206 in the lower row 226 are configured to engage the lower surface 196 of the circuit card 188.

In an exemplary embodiment, the dielectric frame 200 includes openings 230 there through. The openings 230 are located between the signal contacts 204. In an exemplary embodiment, the openings 230 are elongated slots separated by connecting strips 232 between the openings 230. The openings 230 receive corresponding ground rails 400.

Figure 7:
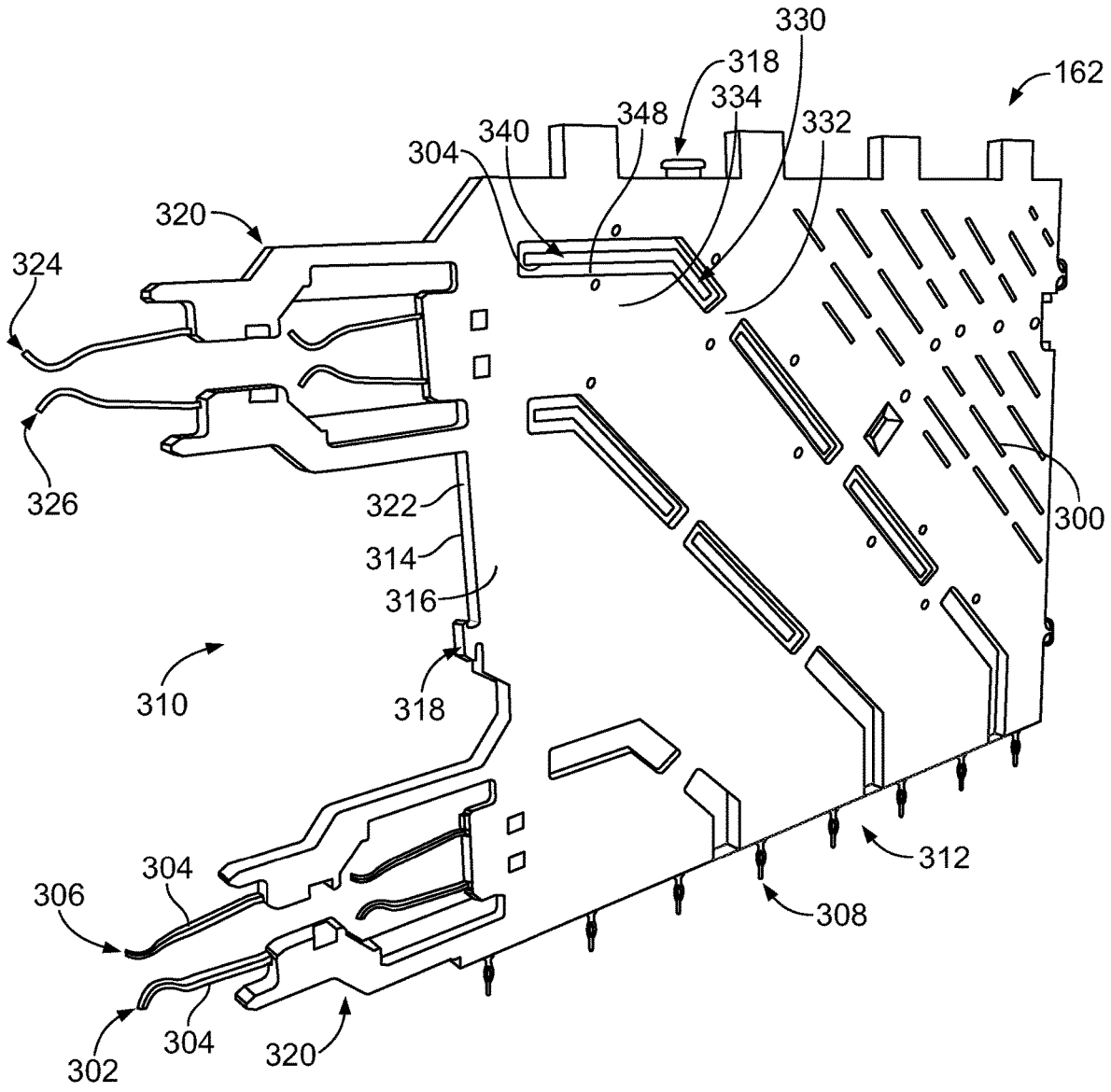
FIG. 7 is a perspective view of a ground wafer of the wafer stack in accordance with an exemplary embodiment.

With additional reference to FIG. 7, which is a perspective view of one of the ground wafers 162, each ground wafer 162 includes a dielectric frame 300 holding a ground leadframe 302 including ground plates 304. In various embodiments, the dielectric frame 300 is formed around the ground leadframe 302. For example, the dielectric frame 300 may be over molded on the ground leadframe 302. The ground plates 304 are embedded in the dielectric frame 300. In an exemplary embodiment, each ground plate 304 extends between a mating end 306 and a terminating end 308. The mating end 306 is configured to be mated with the module circuit card 188 (shown in FIG. 1). For example, the mating end 306 may include a deflectable spring beam configured to be mated with a corresponding contact pad 192 on the circuit card 188 by a compression connection. The terminating end 308 is configured to be terminated to the circuit board 102 (shown in FIG. 1). For example, the terminating end 308 may include a compliant pin configured be press-fit into a plated via of the circuit board 102. In the illustrated embodiment, the mating end 306 is provided at a front 310 of the ground wafer 162 and the terminating end 308 is provided at a bottom 312 of the ground wafer 162 defining a right-angle wafer. The ground plates 304 transition between the front 310 and the bottom 312, such as through one or more bends. Other orientations are possible in alternative embodiments.

In an exemplary embodiment, the dielectric frame 300 includes a first side 314 and a second side 316. Optionally, in various embodiments, the ground wafers 162 may flank one or more signal wafers 160, such as a pair of signal wafers 160 to provide electrical shielding between the corresponding signal wafers 160. The sides 314, 316 may be planar. The dielectric frame 300 may include securing features, such as posts and/or holes, to secure the dielectric frame 300 to the adjacent signal wafers 160. In an exemplary embodiment, the ground wafers 162 include attachment features 318 configured to be attached to the organizer plate 164 (shown in FIG. 3).

In an exemplary embodiment, the ground wafer 162 includes mating protrusions 320 extending forward from a front wall 322 of the dielectric frame 300. In the illustrated embodiment, the ground wafer 162 mating protrusions 320, such as upper and lower mating protrusions 320. The upper and lower mating protrusions 320 are configured be received in the upper and lower housing portions 170, 172 (shown in FIG. 3). The mating ends 306 of the ground plates 304 extend forward from the mating protrusions 320. In an exemplary embodiment, the mating ends 306 are arranged in an upper row 324 and a lower row 326 within each mating protrusion 320. The mating ends 306 in the upper row 324 are configured to engage the upper surface 194 of the circuit card 188 while the mating ends 306 in the lower row 326 are configured to engage the lower surface 196 of the circuit card 188.

In an exemplary embodiment, the dielectric frame 300 includes openings 330 there through. The openings 330 expose portions of the ground plates 304. The openings 330 receive corresponding ground rails 400. In an exemplary embodiment, the openings 330 are elongated slots separated by connecting strips 332 between the openings 330. The connecting strips 332 extend between pads 334 of the dielectric frame 300. The pads 334 transition between the front 310 and the bottom 312. The pads 334 are provided at both sides 314, 316.

Figure 8:
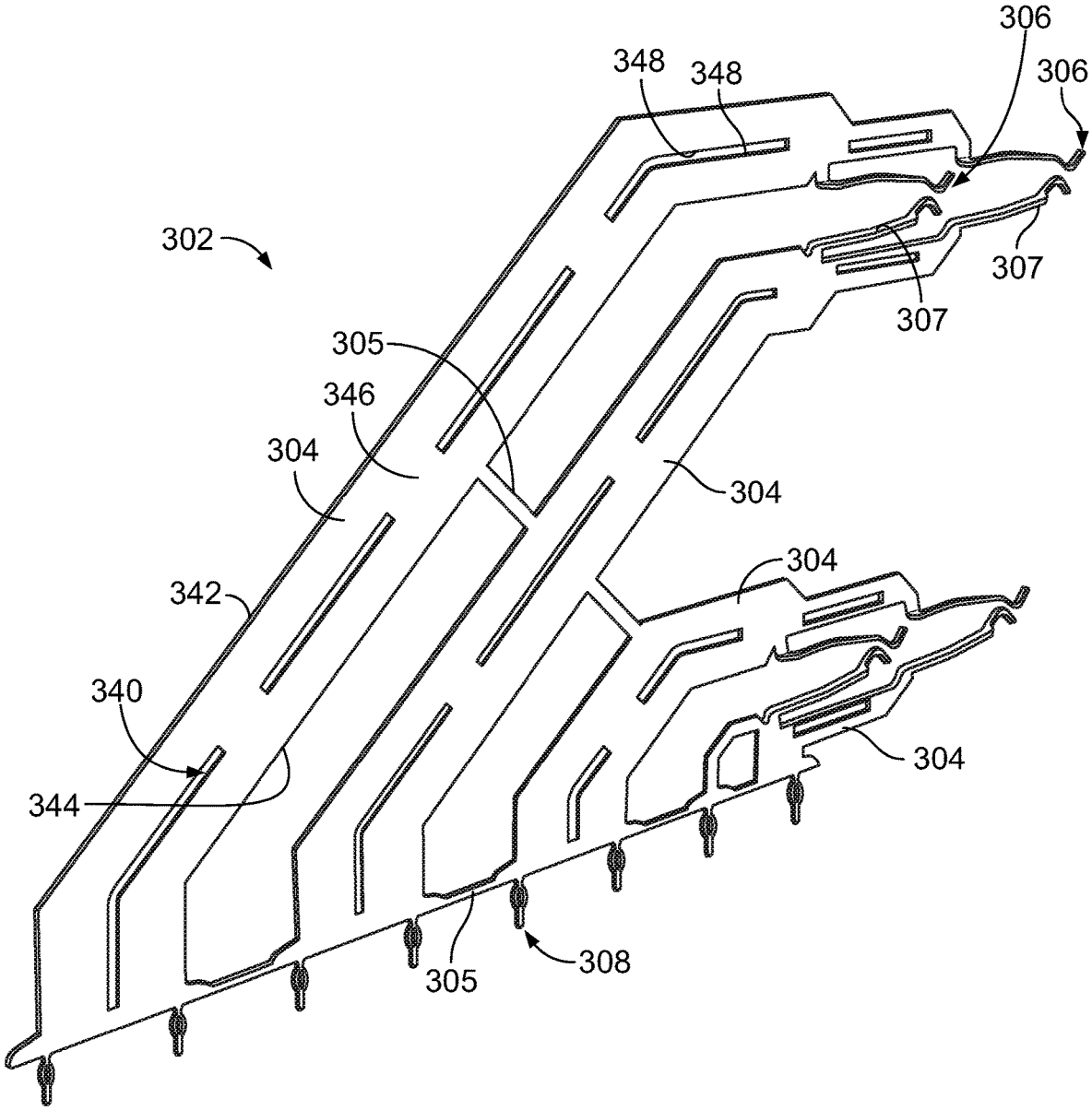
FIG. 8 is a perspective view of a ground leadframe of the ground wafer in accordance with an exemplary embodiment.

With additional reference to FIG. 8, a perspective view of the ground leadframe 302 is provided showing the ground plates 304 extending between the mating ends 306 and the terminating ends 308. In the illustrated embodiment, the ground wafer 162 includes four ground plates 304. The ground plates 304 are connected by tie bars 305 to support the ground plates 304 relative to each other and to electrically connect the ground plates 304 to each other. In an exemplary embodiment, each ground plate 304 includes a pair of spring beams 307 at the mating end 306, such as a forward spring beam and a rear spring beam. The spring beams 307 are configured to engage different contact pads 192 on the module circuit card 188.

In an exemplary embodiment, each ground plate 304 includes one or more rail slots 340 extending therethrough. The rail slots 340 receive corresponding ground rails 400. In the illustrated embodiment, the rail slots 340 are elongated. Optionally, the rail slots 340 may be approximately centered between inner and outer edges 342, 344 of the ground plate 304. The rail slots 340 are separated by connecting strips 346 extending between the rail slots 340. Optionally, the rail slots 340 may be longer than the connecting strips 346. For example, the rail slots 340 may extend a majority of the length of the ground plate 304. In an exemplary embodiment, the ground plates 304 may include protrusions or bumps extending into the rail slots 340. The protrusions are configured to mechanically engage the corresponding ground rail 400 to electrically connect the ground plate 304 to the ground rail 400. In various embodiments, the ground rails 400 are held in the rail slots 340 by an interference fit, such as with the protrusions. Optionally, the protrusions may be crush ribs configured to be deformed when the ground rails 400 are plugged into the rail slots 340. The protrusions may be provided on both sides of the rail slots 340. In various embodiments, the ground rails 400 may be welded to the ground plates 304, such as at the protrusions.

Figure 9:
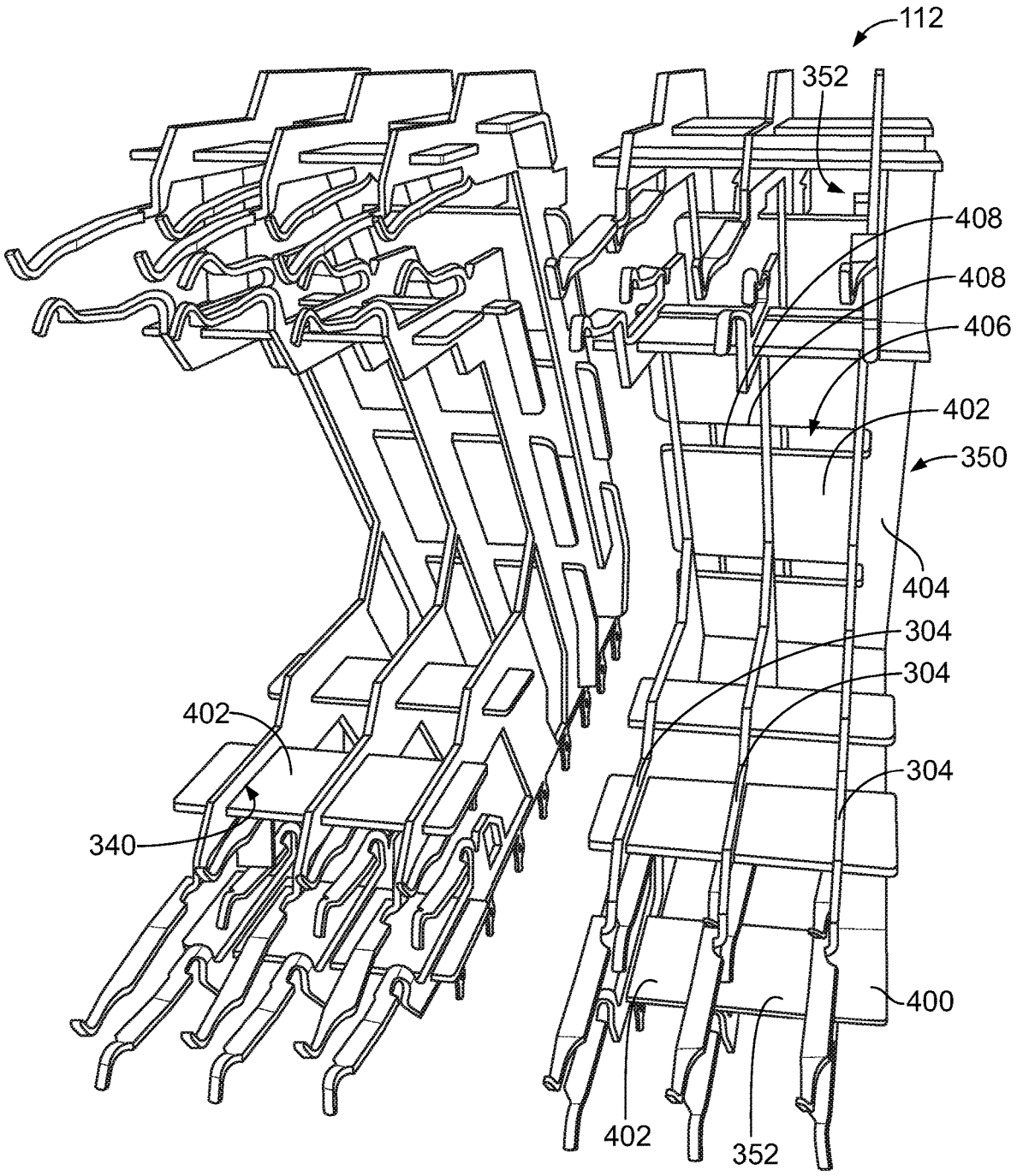
FIG. 9 illustrates a portion of the communication connector showing a shield structure of the communication connector in accordance with an exemplary embodiment.

FIG. 9 illustrates a portion of the communication connector 112 showing a shield structure 350 of the communication connector 112. FIG. 9 shows the ground rails 400 and the ground plates 304 of the ground wafers 162. The ground rails 400 electrically connect the corresponding ground plates 304. For example, the ground rails 400 are separate from the ground wafers 162 and are plugged into the wafer stack 160 to electrically connect to ground plates 304 of corresponding ground wafers 162.

In an exemplary embodiment, the ground rails 400 include rail tabs 402 and tie bars 404. The rail tabs 402 extend from the tie bars 404. The tie bars 404 electrically connect the rail tabs 402. The rail tabs 402 are configured to be plugged into corresponding rail slots 340 of the ground plates 304. Each rail tab 402 is coupled to at least two different ground wafers 162 to electrically connect the at least two different ground wafers 162. The rail tabs 402 are separated by gaps 406. The rail tabs 402 have edges 408 facing each other across the gaps 406.

In an exemplary embodiment, the ground rails 400 and the ground wafers 162 form ground silos 352 bounded by corresponding rail tabs 402 and corresponding ground plates 304. The ground plates 304 provide electrical shielding on opposite sides of the ground silos 352 and the rail tabs 402 provide electrical shielding above and below the ground silos 352. The shield structure 350 provides 360° shielding for signal contacts 204 (shown in FIG. 3) routed in the ground silos 352. For example, pairs of signal contacts 204 may be routed in corresponding ground silos 352. The ground rails 400 and the ground wafers 162 provide a list shielding for the pairs of signal contacts 204 and the ground silos 352.

Figure 10:
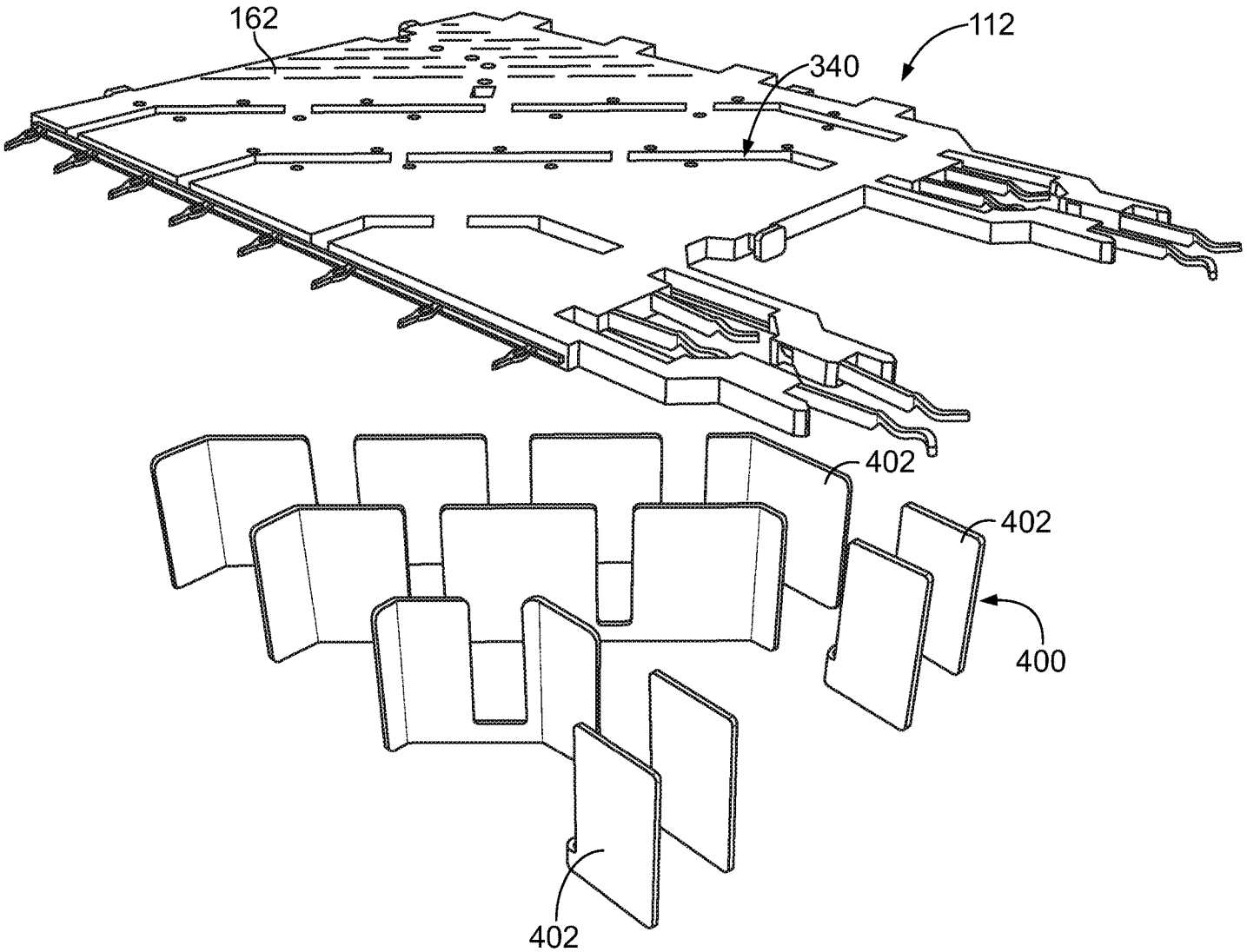
FIG. 10 is an exploded view of a portion of the communication connector in accordance with an exemplary embodiment.

FIG. 10 is an exploded view of a portion of the communication connector 112 in accordance with an exemplary embodiment. FIG. 10 illustrates a plurality of the ground rails 402 of the ground wafers 162 poised for coupling to the ground rails 400. During assembly, the ground rails 400 may be held in a fixture at predetermined locations relative to each other. The ground wafer 162 may be loaded onto the fixture of ground rails 400. For example, the rail slots 340 may be aligned with the rail tabs 402. As the ground wafer 162 is loaded onto the ground rails 400, the rail tabs 402 may be plugged into corresponding rail slots 340.

Figure 11:
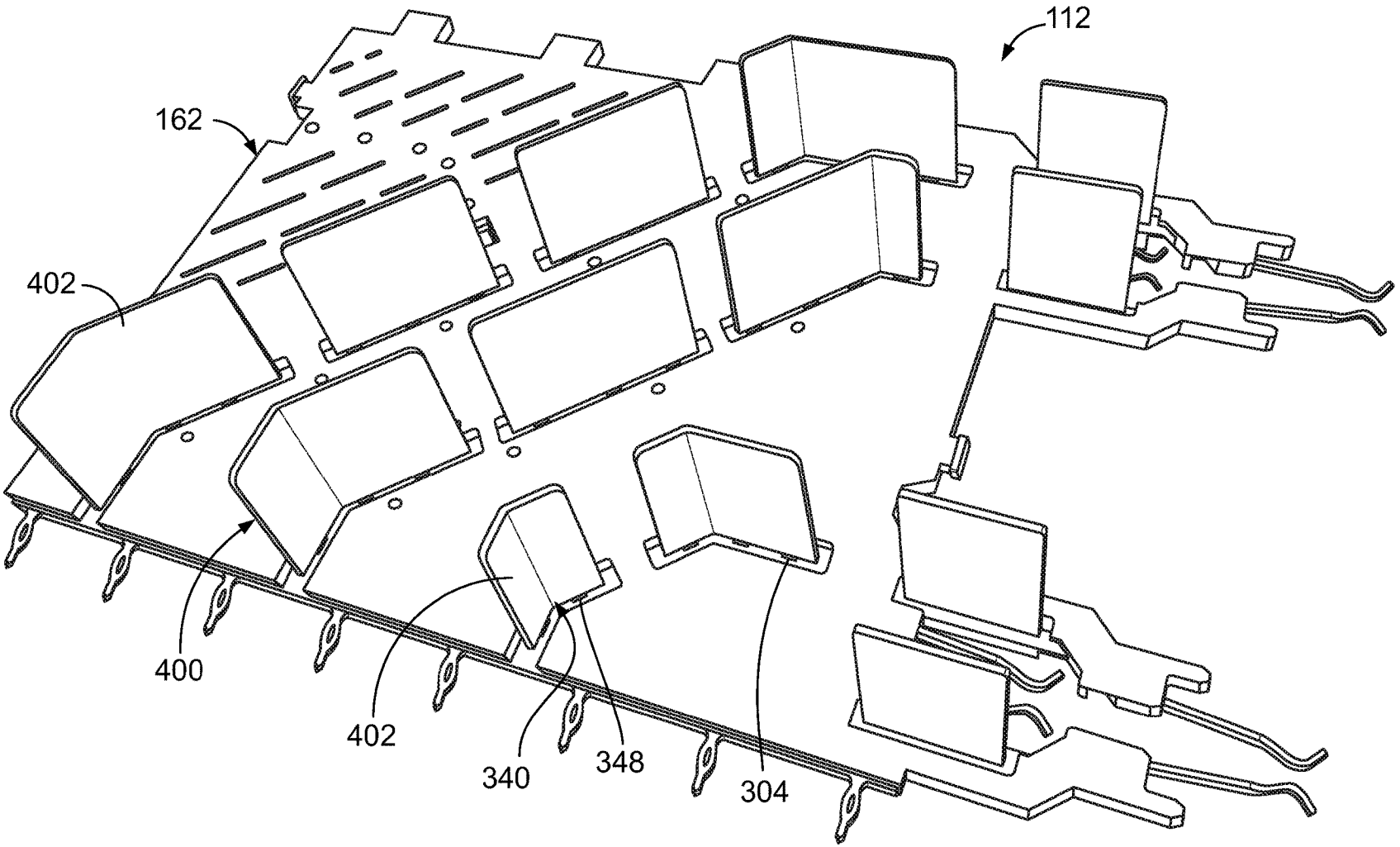
FIG. 11 is a perspective view of a portion of the communication connector in accordance with an exemplary embodiment.

FIG. 11 is a perspective view of a portion of the communication connector 112 in accordance with an exemplary embodiment. FIG. 11 illustrates one of the ground wafers 162 coupled to the fixture of ground rails 400. The rail tabs 402 extend through the rail slots 340. Optionally, the ground plates 304 may be electrically connected to multiple rail tabs 402 along the length of the ground plates 304. However, some ground plates 304 may be too short for multiple rail tabs 402. In an exemplary embodiment, protrusions 348 extend into the rail slots to engage the rail tabs 402. For example, the protrusions 348 may engage the rail tabs 402 by an interference fit to mechanically and electrically connect the rail tabs 402 to the ground plates 304. Optionally, the rail tabs 402 may be welded to the ground plates 304, such as at the protrusions 348. In various embodiments, the rail tabs 402 may be laser welded to the ground plates 304 at multiple weld points to mechanically and electrically connect the rail tabs 402 to the ground plates 304.

Figure 12:
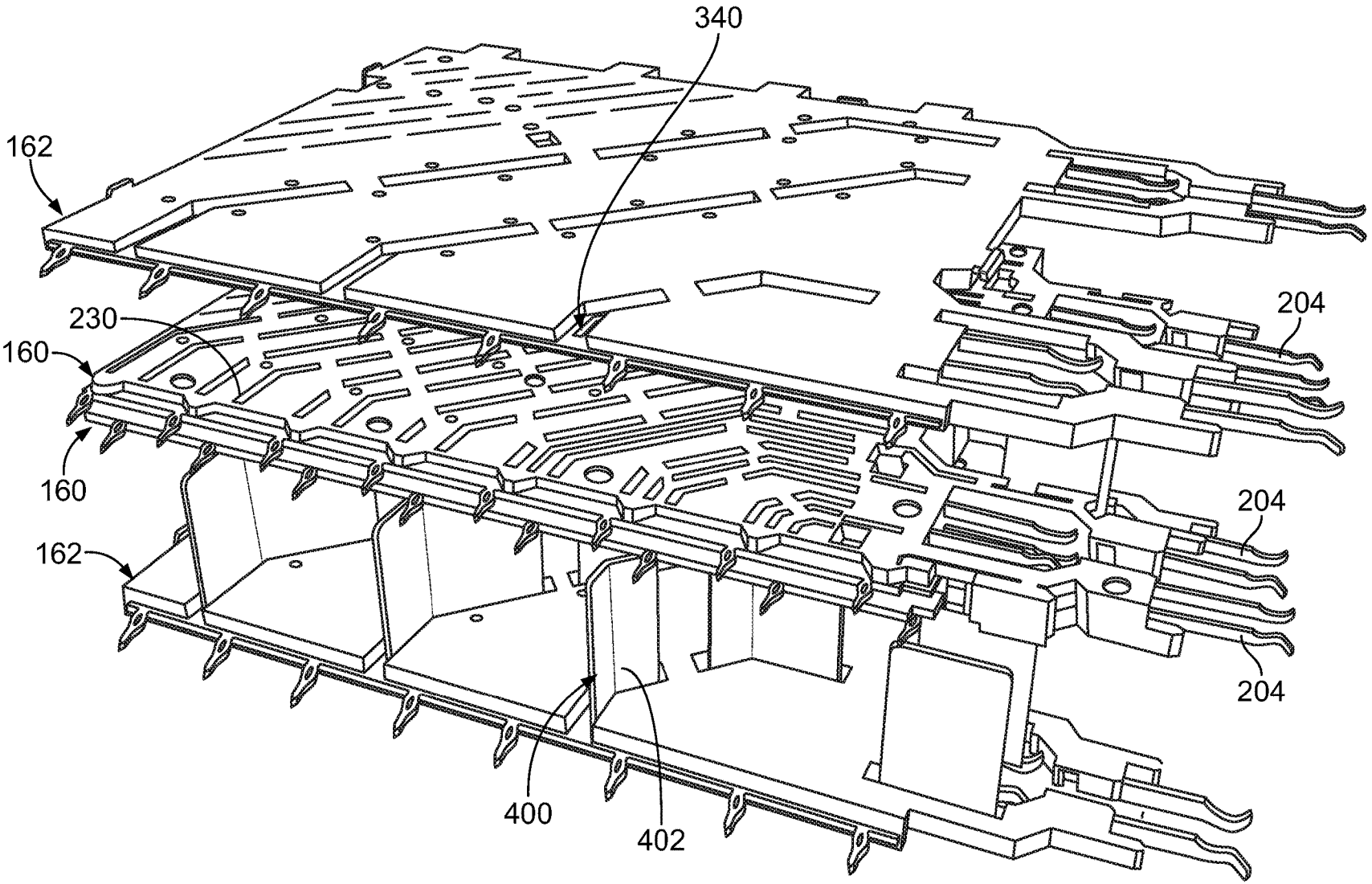
FIG. 12 is an exploded view of a portion of the communication connector in accordance with an exemplary embodiment.

FIG. 12 is an exploded view of a portion of the communication connector 112 in accordance with an exemplary embodiment. FIG. 12 illustrates a first ground wafer 162 coupled to the fixture of ground rails 400, a pair of signal wafers 160 poised for coupling to the fixture of ground rails 400, and a second ground wafer 162 poised for coupling to the fixture of ground rails 400. The openings 230 in the signal wafers 160 are aligned with the rail tabs 402. When the signal wafers 160 are coupled to the ground rails 400, the rail tabs 402 extend through the signal wafers 162 provide electrical shielding for the signal contacts 204 of the signal wafers 160. The rail slots 340 of the second ground wafer 162 are aligned with the rail tabs 402 such that the rail tabs 402 may be plugged into the corresponding rail slots 340.

Figure 13:
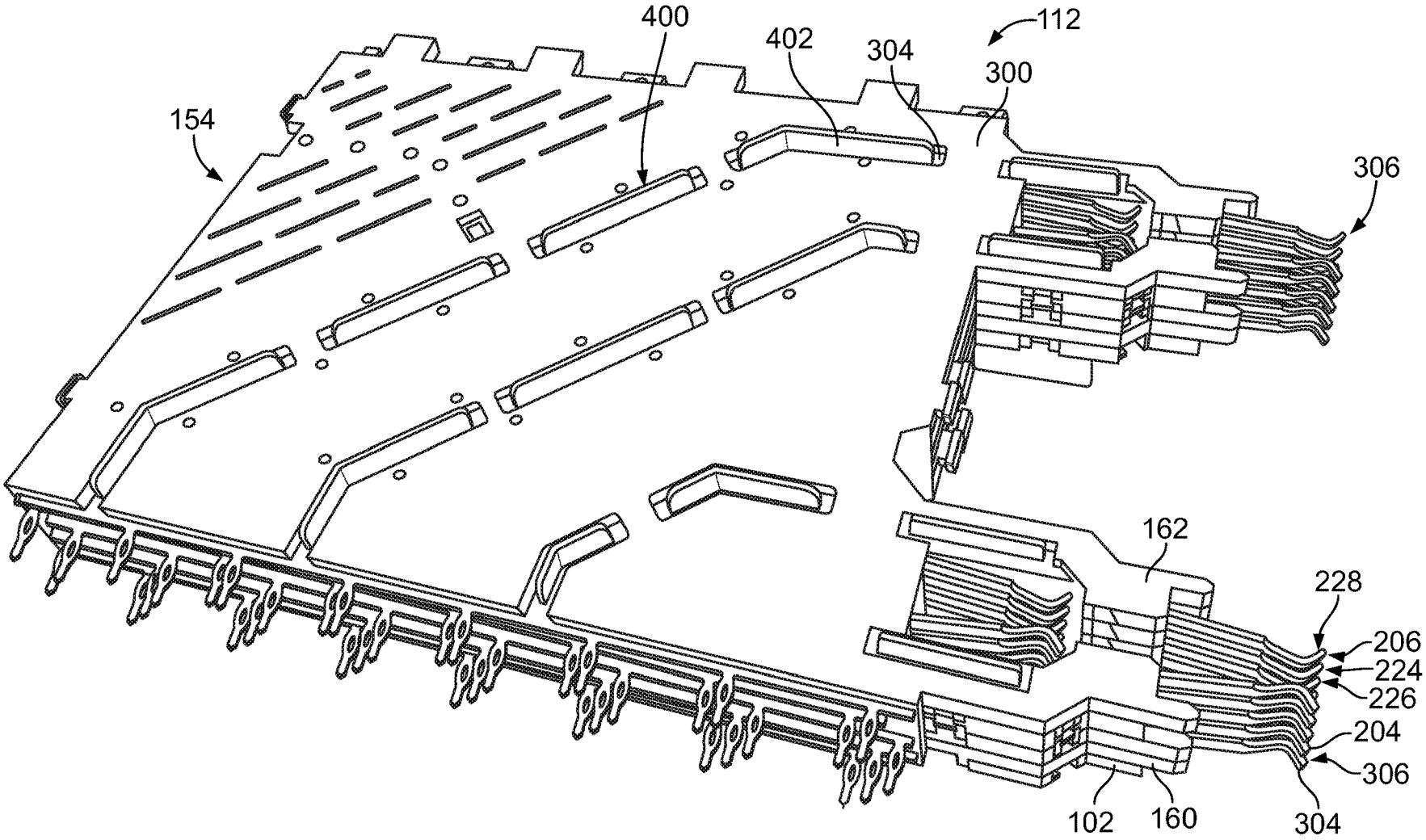
FIG. 13 is an assembled view of a portion of the communication connector in accordance with an exemplary embodiment.

FIG. 13 is an assembled view of a portion of the communication connector 112 in accordance with an exemplary embodiment. FIG. 13 illustrates the left wafer stack 154 in an assembled state. A plurality of the signal wafers 160 and a plurality of the ground wafers 162 are stuck together to form the left wafer stack 154. Each of the ground wafers 162 in the left wafer stack 154 are electrically connected by the rail tabs 402 of the ground rails 400. The rail tabs 402 extend through the openings 330 in the dielectric frame 300 of the ground wafer 162.

In an exemplary embodiment, the signal contacts 204 are arranged in pairs. The mating ends 206 of the signal contacts 204 and the mating ends 306 of the ground plates 304 are aligned in the upper rows 224 and the lower rows 226. The mating ends 206 and the mating ends 306 oppose each other across pair gaps 228 between the upper rows 224 and the lower rows 226.

Figure 14:
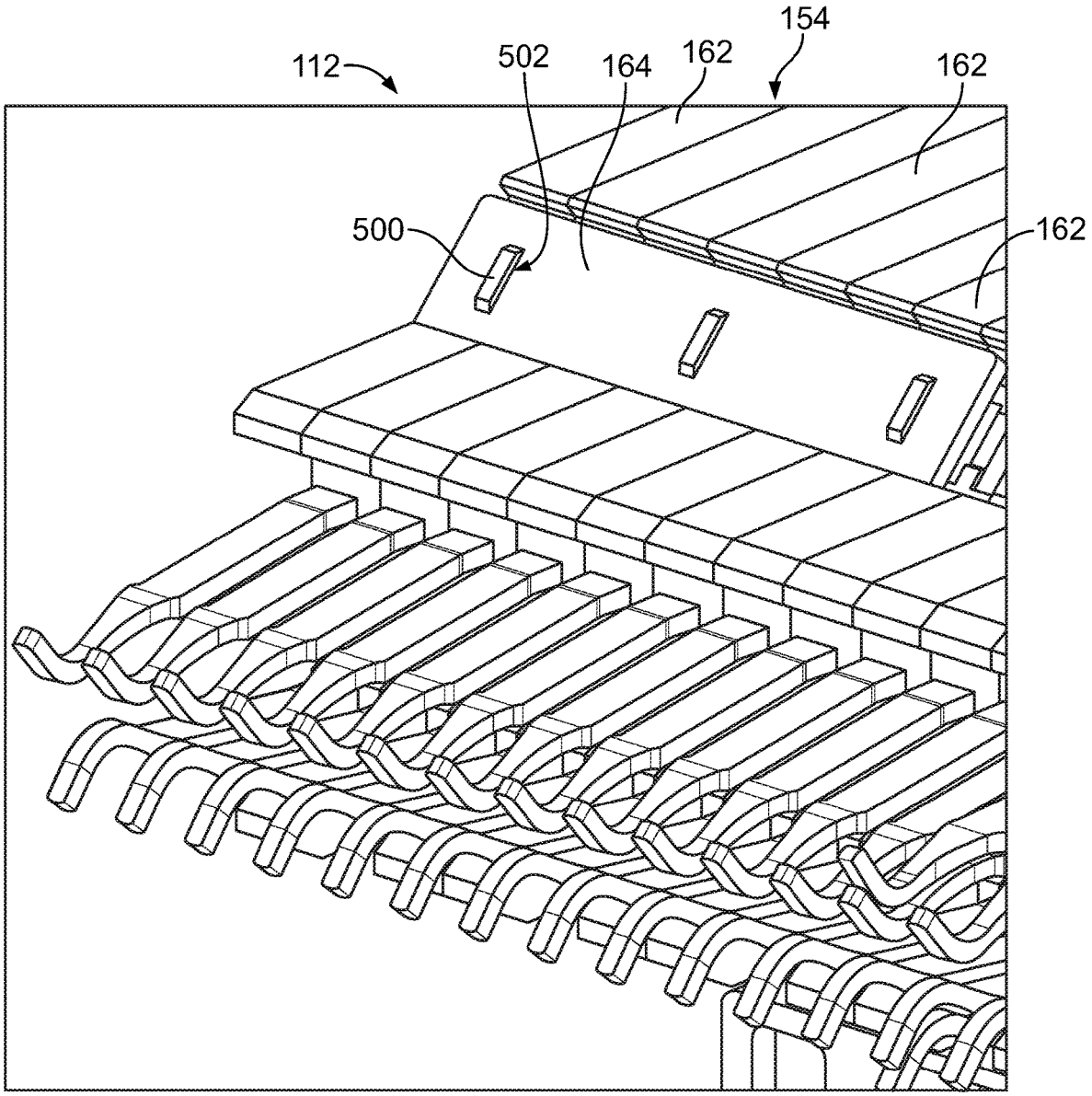
FIG. 14 is a front perspective view of a portion of the communication connector in accordance with an exemplary embodiment.

FIG. 14 is a front perspective view of a portion of the communication connector 112 in accordance with an exemplary embodiment. FIG. 14 illustrates one of the organizer plates 164 coupled to the wafer stack 154. The organizer plate 164 is coupled to the ground wafers 162. In an exemplary embodiment, the ground wafers 162 include tabs 500 received in openings 502 in the organizer plate 164. The tabs 500 are electrically connected to the ground plates 304.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A communication connector for a communication system, the communication connector comprising:

a wafer stack including ground wafers and signal wafers arranged in a stacked configuration;

each signal wafer including a dielectric frame holding a signal leadframe, the signal leadframe including a plurality of signal contacts;

each ground wafer including a dielectric frame holding a ground leadframe, the ground leadframe including ground plates connected by tie bars, the ground plates include rail slots therethrough; and ground rails separate from the ground wafers and being plugged into the wafer stack to electrically connect to corresponding ground wafers, the ground rails having rail tabs passing through the dielectric frame and the signal leadframe of at least one signal wafer, the rail tabs received in corresponding rail slots and being coupled to ground plates of corresponding ground wafers, wherein each rail tab is coupled to at least two different ground wafers to electrically connect the at least two different ground wafers.

2. The communication connector of claim 1, wherein each rail tab extends through at least one signal wafer to provide electrical shielding for signal contacts of the at least one signal wafer.

3. The communication connector of claim 1, wherein the ground plates include protrusions extending into the rail slots to mechanically engage the corresponding rail tabs.

4. The communication connector of claim 1, wherein the rail tabs are welded to the ground plates at multiple weld points to mechanically and electrically connect the rail tabs to the ground plates.

5. The communication connector of claim 1, wherein the rail tabs engage the ground plates by an interference fit to mechanically and electrically connect the rail tabs to the ground plates.

6. The communication connector of claim 1, wherein each ground plate includes multiple rail slots for electrically connecting to multiple ground rails.

7. The communication connector of claim 1, wherein the dielectric frame of the ground wafer includes openings exposing the ground plates and the rail slots, the ground rails being received in corresponding openings.

8. The communication connector of claim 1, wherein the dielectric frame of the signal wafer includes openings therethrough between signal contacts, the openings receiving the corresponding ground rails.

9. The communication connector of claim 1, wherein the signal contacts are arranged in pairs, the signal contacts include mating ends, the mating ends opposing each other across pair gaps configured to receive a card edge of a circuit card for mating to opposing sides of the circuit card.

10. The communication connector of claim 9, wherein the ground plates are arranged in pairs, the ground plates include mating ends, the mating ends opposing each other across pair gaps configured to receive the card edge of the circuit card for mating to opposing sides of the circuit card, the mating ends of the ground plates being aligned with the mating ends of the signal contacts.

11. The communication connector of claim 1, wherein each ground rail includes tie bars connecting the rail tabs of the ground rails, the ground rails having gaps between the rail tabs, the rail tabs having edges facing each other across the gaps.

12. The communication connector of claim 11, wherein the dielectric frame of the ground wafer includes pads located between ground rails and connecting strips extending between pads, the connecting strips passing through gaps between rail tabs.

13. The communication connector of claim 1, wherein the ground wafers of the wafer stack include a first ground wafer and a second ground wafer and the signal wafers of the wafer stack include a first signal wafer and a second signal wafer, the first and second signal wafers being located between the first and second ground wafers.

14. The communication connector of claim 1, wherein the ground rails and the ground wafers form ground silos bounded by corresponding rail tabs and corresponding ground plates, the signal contacts being arranged in pairs routed in corresponding ground silos, the ground rails and the ground wafers provide electrical shielding for the pairs of signal contacts in the ground silos.

15. A communication connector comprising:

a left grounded wafer stack having ground wafers and signal wafers arranged in a stacked configuration, each signal wafer of the left grounded wafer stack including a dielectric frame holding a signal leadframe including a plurality of signal contacts, each ground wafer of the left grounded wafer stack including a dielectric frame holding a ground leadframe including ground plates connected by tie bars and having rail slots therethrough, the left grounded wafer stack including ground rails separate from the ground wafers and being plugged into the left grounded wafer stack to electrically connect to corresponding ground wafers, the ground rails having rail tabs received in corresponding rail slots and being coupled to ground plates of corresponding ground wafers, wherein each rail tab extends through at least one signal wafer to provide electrical shielding for signal contacts of the at least one signal wafer, and wherein each rail tab is coupled to at least two different ground wafers to electrically connect the at least two different ground wafers;

a right grounded wafer stack having ground wafers and signal wafers arranged in a stacked configuration, each signal wafer of the right grounded wafer stack including a dielectric frame holding a signal leadframe including a plurality of signal contacts, each ground wafer of the right grounded wafer stack including a dielectric frame holding a ground leadframe including ground plates connected by tie bars and having rail slots therethrough, the right grounded wafer stack including ground rails separate from the ground wafers and being plugged into the right grounded wafer stack to electrically connect to corresponding ground wafers, the ground rails having rail tabs received in corresponding rail slots and being coupled to ground plates of corresponding ground wafers, wherein each rail tab extends through at least one signal wafer to provide electrical shielding for signal contacts of the at least one signal wafer, and wherein each rail tab is coupled to at least two different ground wafers to electrically connect the at least two different ground wafers; and a center wafer stack having ground wafers and signal wafers arranged in a stacked configuration, each signal wafer including a dielectric frame holding a signal leadframe including a plurality of signal contacts, each ground wafer including a dielectric frame holding a ground leadframe including ground plates, the ground wafers of the center wafer stack being electrically isolated from each other;

wherein the center wafer stack is located between the left and right grounded wafer stacks.

16. The communication connector of claim 15, wherein the signal contacts of the left grounded wafer stack and the signal contacts of the right grounded wafer stack are arranged in pairs conveying high speed data signals, the signal contacts of the center wafer stack convey low speed data signals.

17. The communication connector of claim 15, wherein the signal contacts of the left grounded wafer stack, the right grounded wafer stack, and the center wafer stack include mating ends, the ground plates of the left grounded wafer stack, the right grounded wafer stack, and the center wafer stack include mating ends, the mating ends of the signal contacts and the mating ends of the ground plates being aligned in upper and lower rows across a gap configured to receive a card edge of a circuit card.

18. The communication connector of claim 15, wherein the ground wafers of the left grounded wafer stack include a first ground wafer and a second ground wafer and the signal wafers of the left grounded wafer stack include a first signal wafer and a second signal wafer, the first and second signal wafers being located between the first and second ground wafers, and wherein the ground wafers of the right grounded wafer stack include a third ground wafer and a fourth ground wafer and the signal wafers of the right grounded wafer stack include a third signal wafer and a fourth signal wafer, the third and fourth signal wafers being located between the third and fourth ground wafers.

19. A communication system comprising:

a receptacle cage configured to be mounted to a circuit board, the receptacle cage having walls including a top wall, a front wall, a rear wall and sidewalls defining a cavity configured to receive a pluggable module; and a communication connector received in the receptacle cage for mating with the pluggable module, the communication connector including a wafer stack having ground wafers and signal wafers arranged in a stacked configuration, each signal wafer including a dielectric frame holding a signal leadframe including a plurality of signal contacts, each ground wafer including a dielectric frame holding a ground leadframe including ground plates connected by tie bars and having rail slots therethrough, the communication connector including ground rails separate from the ground wafers and being plugged into the wafer stack to electrically connect to corresponding ground wafers, the ground rails having rail tabs received in corresponding rail slots and being coupled to ground plates of corresponding ground wafers, wherein each rail tab extends through at least one signal wafer to provide electrical shielding for signal contacts of the at least one signal wafer, and wherein each rail tab is coupled to at least two different ground wafers to electrically connect the at least two different ground wafers.

20. The communication system of claim 19, wherein the communication connector includes a front housing having a card slot, mating ends of the signal contacts and mating ends of the ground plates being arranged in the card slot for mating with a circuit card of the pluggable module.

* * * * *